US008656724B2

(12) United States Patent
Cawley et al.

(10) Patent No.: US 8,656,724 B2
(45) Date of Patent: Feb. 25, 2014

(54) ALUMINIUM COMBUSTION POWER SYSTEM

(75) Inventors: Thomas Cawley, Pennsylvania Furnace, PA (US); Brian Lowery, Bellefonte, PA (US); Timothy F. Miller, State College, PA (US); John Herr, Bellefonte, PA (US); Martin Klanchar, State College, PA (US); Daniel H. Kiely, State College, PA (US)

(73) Assignee: The Penn State Research Foundation, University Park, PA (US)

( * ) Notice: Subject to any disclaimer, the term of this patent is extended or adjusted under 35 U.S.C. 154(b) by 503 days.

(21) Appl. No.: 13/084,905

(22) Filed: Apr. 12, 2011

(65) Prior Publication Data

US 2011/0252800 A1 Oct. 20, 2011

Related U.S. Application Data

(60) Provisional application No. 61/325,995, filed on Apr. 20, 2010.

(51) Int. Cl.

| | |
|---|---|
| ***F02C 7/08*** | (2006.01) |
| ***F02C 3/00*** | (2006.01) |
| ***F02M 27/02*** | (2006.01) |

(52) U.S. Cl.
USPC ..... 60/775; 60/39.55; 60/39.58; 60/39.59

(58) Field of Classification Search
USPC ..... 60/772, 775, 39.53, 39.55, 39.58, 60/39.59, 670
See application file for complete search history.

(56) References Cited

U.S. PATENT DOCUMENTS

| | | | | |
|---|---|---|---|---|
| 3,158,994 | A * | 12/1964 | Hodgson | 60/220 |
| 3,229,462 | A * | 1/1966 | Fatica | 60/793 |
| 3,985,866 | A | 10/1976 | Oda et al. | |
| 5,086,720 | A * | 2/1992 | Gibran | 110/234 |
| 5,867,978 | A | 2/1999 | Klanchar et al. | |
| 6,413,588 | B1 | 7/2002 | Pettus et al. | |
| 7,430,866 | B1 | 10/2008 | Lynch et al. | |
| 7,963,115 | B1 * | 6/2011 | Sondergaard et al. | 60/645 |
| 2007/0056210 | A1 | 3/2007 | Schmidt | |

* cited by examiner

*Primary Examiner* — Hoang Nguyen
(74) *Attorney, Agent, or Firm* — Gifford, Krass, Sprinkle, Anderson & Citkowski, P.C.

(57) ABSTRACT

An engine that oxidizes aluminum with water to produce electrical and/or mechanical power. The engine can include a fuel made at least partly from aluminum powder that flows like liquid under high pressure. The engine can also include a steam supply system, a combustor, a fuel feed system, a fuel injection system, and a water supply system.

18 Claims, 3 Drawing Sheets

ALUMINIUM COMBUSTION POWER SYSTEM

CROSS-REFERENCE TO RELATED APPLICATIONS

This application claims priority of U.S. Provisional Patent Application Ser. No. 61/325,995 filed Apr. 20, 2010, which is incorporated herein by reference in its entirety.

GOVERNMENT INTEREST

This invention was made with government support under Contract No. N00024-02-D-6604, DO#0031, awarded by the US Department of the Navy, Naval Sea Systems Command. The Government has certain rights in the invention.

FIELD OF THE INVENTION

The present invention is related to an aluminum combustion power system, and in particular an aluminum combustion power system that reacts water with aluminum powder to produce molten aluminum oxide droplets, heat, steam, and hydrogen.

BACKGROUND OF THE INVENTION

The use of internal combustion engines, batteries, jet propulsion, and the like to provide power to underwater vehicles is known. In addition, the use of batteries has exhibited limited success, however the energy density of battery powered systems has been less than desirable.

As an alternative, the chemical reaction of aluminum with water, fresh or salt, is known to be highly energetic and has been proposed as a basis for an energy producing system. The basic reaction between aluminum and water is $$2Al+3H_2O \rightarrow Al_2O_3+3H_2 \qquad \text{Equation 1}$$

with the products of this reaction exhibiting temperatures up to 3800° F. However, such temperatures and products have heretofore proven to be impractical for power systems that can provide a steady and sustained flow of energy. Therefore, even though the above chemical reaction is extremely energy favorable, the use of aluminum as a fuel to provide a reliable source of energy has proven evasive. Therefore, a power source that reacts aluminum with water and provides reliable power would be desirable.

SUMMARY OF THE INVENTION

The present invention discloses an engine that reacts aluminum with water to produce electrical and/or mechanical power. The engine can include a fuel made at least partly from aluminum powder that flows like liquid under high pressure. The engine can also include a steam feedback system, a combustor, a fuel feed system, a fuel injection system, and a water supply system.

The combustor can have an inlet, an outlet, and a combustor wall, and the fuel feed system is operable to pump the fuel from a fuel tank to the combustor. The fuel injection system can mix steam that is fed back or recirculated from the combustor discharge via a small compressor or generated from a recuperator with the fuel and then spray the fuel and the steam mixture into the combustor. The water supply system can spray water into the combustor and the water can react with the aluminum powder to produce molten aluminum oxide droplets, heat, steam, and hydrogen. In addition, the water can solidify the molten aluminum oxide droplets before they contact the combustor wall and thereby prevent clogging of the combustor.

The aluminum powder can be coated, for example with a film of methysiloxane, such that the coated aluminum powder can be pumped through tubing having a length to diameter ratio of greater than 1000. In addition, the fuel feed system is operable to provide a steady flow of the coated aluminum powder at high pressure to the combustor. The mixture of aluminum powder and steam reacts with water in the combustor to produce the molten aluminum oxide droplets, heat, additional steam, and hydrogen. The water supply system can include a plurality of spray nozzles that can spray water into the combustor and cool the combustor wall. In addition, a high temperature separator downstream from the combustor can separate solidified aluminum oxide particles from an aluminum oxide particle-steam mixture that exits the outlet of the combustor. In this manner, steam without harmful and/or erosive aluminum oxide particles can be provided to a steam turbine to produce electrical and/or mechanical power.

DETAILED DESCRIPTION OF THE INVENTION

Figure 1:
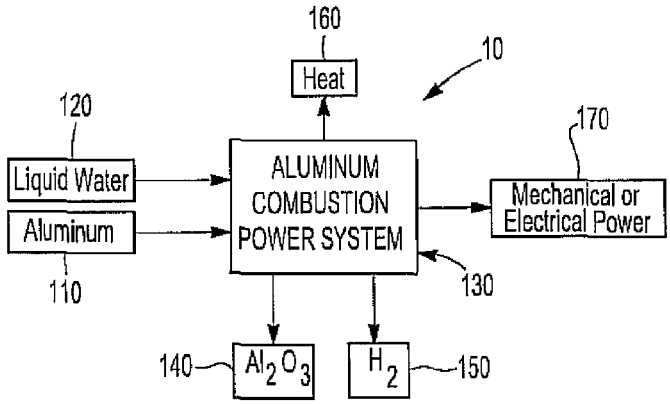
FIG. 1 is a schematic diagram of an aluminum combustion power system according to an embodiment of the present invention.

The present invention provides an engine that reacts aluminum with water to produce electrical and/or mechanical power. As such, the present invention has use as a power source.

The power system can include a combustor that is operable to accept aluminum powder mixed with steam. In addition, the combustor can have water sprayed thereinto, the water reacting with the aluminum powder to form molten aluminum oxide droplets, steam, heat, and hydrogen. In addition, sufficient water can be provided to the combustor such that excess steam is provided and used to drive/power a steam turbine as is known to those skilled in the art.

The aluminum powder can be coated such that it flows like a liquid and can be provided from a fuel container to the combustor using a fuel line having a length to diameter ratio of greater than 1000. In addition, the aluminum powder can be mixed with the steam prior to entering the combustor such that the mixture expands like a gas upon entering a combustion zone. Aluminum particles can then react with water within the combustion zone via the chemical reaction of Equation 1 and as described in greater detail below. Water can also be introduced into the combustor such that it cools the walls thereof and solidifies molten aluminum oxide droplets formed by the reaction of the aluminum powder with the water. Cooling of the molten aluminum oxide droplets before they come into contact with the combustor wall prevents their accumulation thereon and thus prevents clogging of the combustor. As such, aluminum oxide particles plus steam exit the combustor and enters a high temperature separator that affords for the removal or separation of solidified aluminum oxide particles from the steam. Thereafter, the steam can be provided to a steam turbine which rotates to provide mechanical and/or electrical power. It is appreciated that a recuperator, condenser, low temperature separator, steam compressor, etc., can also be included as part of the power system in order to increase power output, efficiency, safety and the like.

A reaction in which excess water can be included to regulate the product temperature of aluminum reacting with water can be:

$$2Al+3H_2O+XH_2O \rightarrow Al_2O_3+3H_2+XH_2O \qquad \text{Equation 2}$$

where X moles of excess water can be included to regulate the temperature of a system that burns aluminum in this manner. In some instances, the X moles of excess diluent water can appear in the products as X moles of superheated steam and the steam can be used to provide energy, for example through the use of a steam turbine. It is appreciated that the number of moles of excess water required can depend on the product discharge temperature and the temperature of liquid water added to the reaction. For example, a product temperature in the vicinity of 1500° F. will result in a gaseous mixture of 97.5% steam.

While Equation 2 is relatively simple and energetically favorable, sustaining such a reaction using readily available cold seawater can be difficult. In particular, solid aluminum does not appreciably react with cold water. As such, and as discussed in more detail below, the present invention affords for high temperature steam to be provided to the reaction of aluminum with water. The aluminum can readily react with the high temperature steam in order to provide sufficient heat to maintain the $Al_2O_3$—$H_2O$ reaction and drive a steam turbine, preheat cold seawater, and the like. In some instances, more or less than 3 moles of steam might be supplied per every two moles of fuel with evaporating diluent water serving as reactant water if necessary.

Turning now to FIG. 1, a "black box" illustration of an inventive aluminum combustion power system is shown generally at reference numeral 10. The power system 10 can include an input of aluminum 110 and liquid water 120. Reaction of the aluminum 110 with the liquid water 120 results in the production of aluminum oxide 140, hydrogen gas 150, and heat 160. In addition, mechanical or electrical power 170 can be produced from the power system 10, for example through the use of steam to drive a steam turbine.

It is appreciated that if the system 10 is used underwater, only aluminum 110 is needed to be stored since liquid water 120 can be provided by the environment. Such a system is analogous to a motor vehicle or an airplane carrying a liquid hydrocarbon fuel and using oxygen/air from the surrounding environment.

In addition to maintaining the reaction of aluminum with water, the aluminum oxide 140 can be formed as molten liquid droplets with a melting/solidification temperature approaching 3800° F. Such droplets can impinge on a surface of the system 10 and cause accelerated corrosion, slagging, and the like. In particular, slagging can result in the buildup of aluminum oxide on internal surfaces of the system 10 and thereby result in clogging of the power system 10.

Figure 2A:
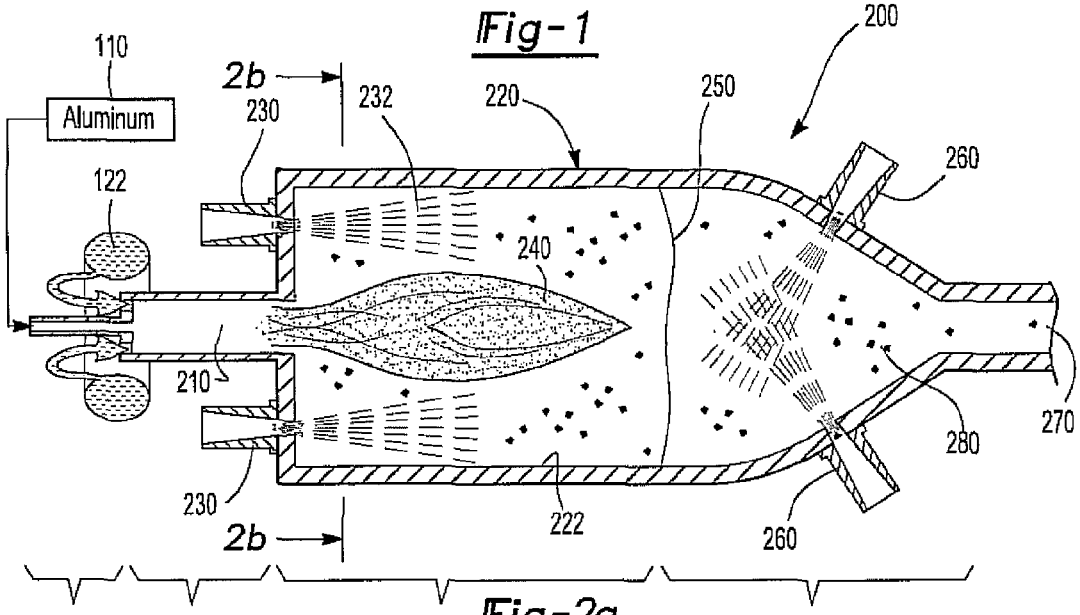
FIG. 2*a* is a side cross-sectional view of a combustor for an aluminum combustion power system according to an embodiment of the present invention.

Referring now to FIG. 2*a*, an inventive aluminum combustor that can prevent clogging of a power system is shown generally at reference numeral 200. The aluminum combustor 200 can include a combustor can 220 with an injection tube 210. Aluminum 110 and steam 122 can be premixed within the injection tube 210 and allowed to react within the combustor can 220 to provide a stoichiometric combustion cloud 240. The combustor can 220 can have a combustor interior wall 222 which provides a physical barrier to the combustion cloud 240. In order to prevent overheating and/or slagging of the combustor interior wall 222, one or more water sprayers 230 can provide coolant 232, e.g. water, to cool the combustor interior wall 222 and quench aluminum oxide droplets that have formed in the combustion cloud 240. In some instances, the combustor can 220 can be cylindrical shaped with a plurality of sprayers 230 spaced apart and providing liquid spray 232 as shown in FIG. 2*b*.

Figure 2B:
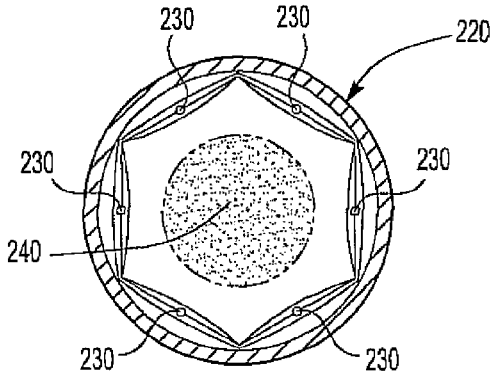
FIG. 2*b* is an end cross-sectional view of section 2*b*-2*b* shown in FIG. 2*a;*

For example, and for illustrative purposes only, FIG. 2*b* illustrates a cylindrical combustor can 220 with six liquid sprayers 230 operable to provide liquid spray into the combustor can 220 and thereby cool the combustor interior walls 222 and/or quench liquid aluminum oxide droplets before reaching the interior walls 222. It is appreciated that the liquid spray 232 can also provide water which can be heated and evaporated into steam and thereby provide a steam shroud 250 within the combustor can 220. Additional water spraying nozzles 260 may or may not be provided to enhance the cooling of the combustor interior walls 222 and/or evaporation of water. As shown in the figure, hot gas and fly ash in the form of aluminum oxide particles 280 can exit the combustor can 220 through an exit 270. It is appreciated that the combustor 220 can provide pressurized and/or superheated steam which can be used to power a steam turbine, extract heat therefrom, and the like.

Figure 3:
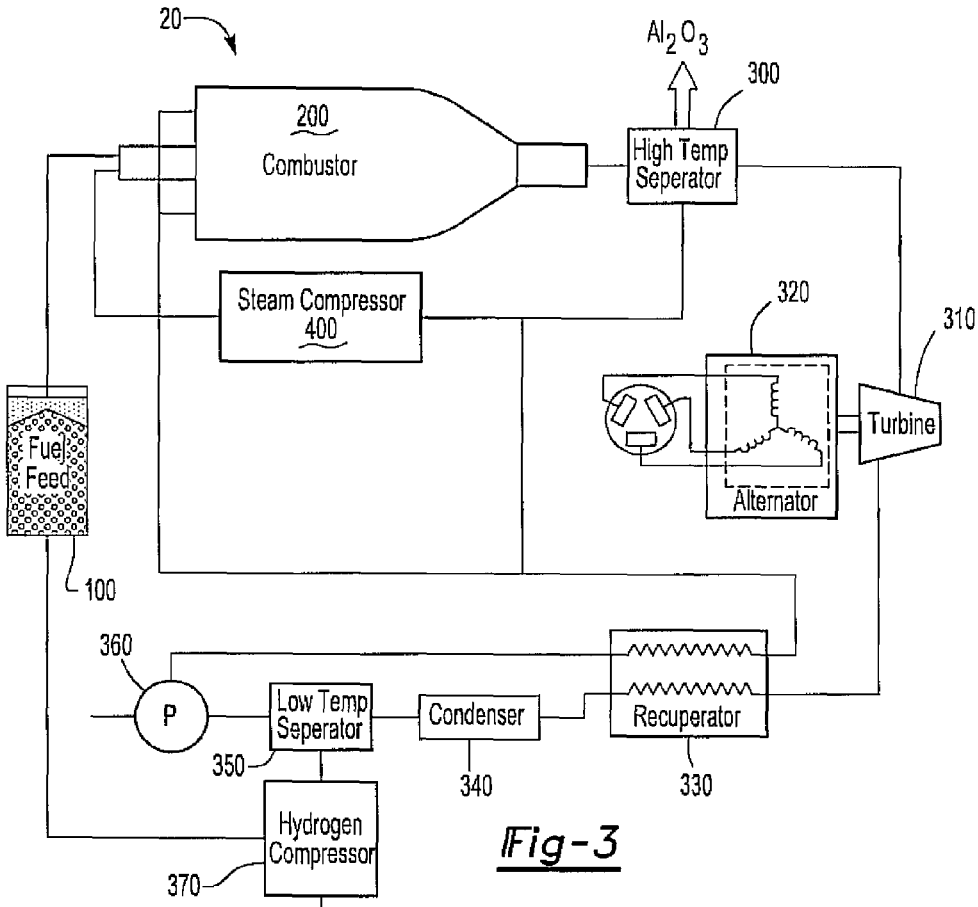
FIG. 3 is a schematic diagram of an aluminum combustion power system that employs the combustor shown in FIG. 1.

Turning now to FIG. 3, a schematic diagram of an aluminum combustion power system is shown generally at reference numeral 20. In addition to the combustor 200, which can in fact be a compact superheated steam generator, a high-temperature separator 300 can be located downstream from the combustor 200 and afford for separation of more than 99% of the aluminum oxide particles from the oxide particle-steam mixture exiting the combustor 200. In addition, any remaining particles can be less than one-half (0.5) micron in diameter and thereby pass through a turbine 310 safely. The turbine 310 may or may not have a direct drive with a high-speed alternator 320, the alternator 320 operable to generate alternating current which can be rectified and otherwise conditioned to provide a regulated direct current voltage. In some instances, the turbine 310 and alternator 320 can be water cooled and use water lubricated hybrid bearings.

It is appreciated that exhaust from the turbine 310 can contain considerable energy content and, as such, a recuperator 330 can be used to transfer heat from the turbine exhaust to liquid water in the form of incoming seawater, freshwater and/or water condensed from the exhaust steam. By preheating water supplied to the combustor water sprayers 230, more water can be added to the combustor 200 in order to maintain a desired combustor discharge temperature. The additional water added to the combustor 200 can be converted into steam and thereby increase steam flow from the combustor 200 and through the turbine 310. In this manner, the output power from the turbine 310 and the overall efficiency of the system 20 can be increased. It is appreciated that the hydrogen flowing out of the recuperator represents a considerable potential energy source and in certain instances may be directed to a secondary combustor, electrochemical fuel cell of other conversion system to enhance overall system efficiency.

Cooler steam leaving the recuperator 330 can be condensed in a condenser 340 to liquid water and thereafter discharged to a low-temperature separator 350. The low-temperature separator 350 can separate gaseous hydrogen which may or may not be pumped overboard with any residual aluminum oxide. In some instances, a portion of hydrogen compressed in the low-temperature separator can be retained for feed system use. In addition, a water pump 360 can pump surrounding seawater, freshwater and/or steam condensate from the low-temperature separator 350 and raise the pressure of the liquid to above the pressure in the combustor 200 for use in the water sprayers 230.

A steam compressor 400 can also be included and provide high-temperature steam for combustion of the aluminum powder. In some instances, clean steam can be taken from the high-temperature separator 300, passed through the steam compressor 400, and mixed with aluminum powder from the fuel feed system 100. In addition, temperature(s) of the aluminum powder fuel and steam from the steam compressor 400 at the inlet 210 of the combustor 200 can be controlled and/or reduced by addition of liquid water.

Figure 4A:
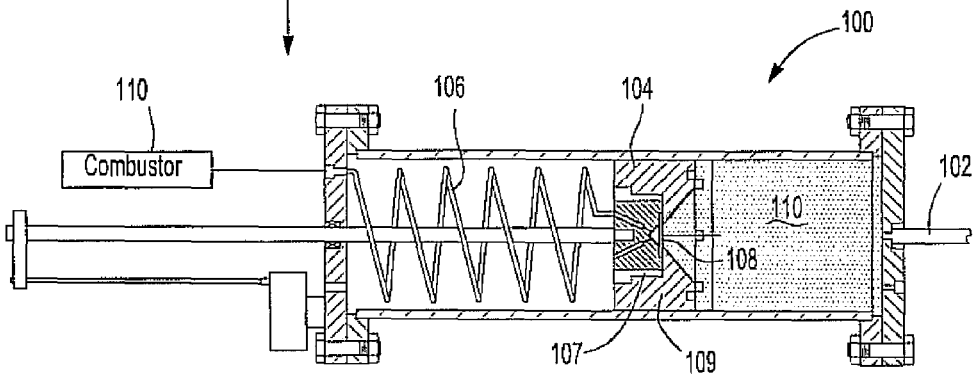
FIG. 4*a* is a side cross-sectional view of a fuel supply system according to an embodiment of the present invention.
Figure 4B:
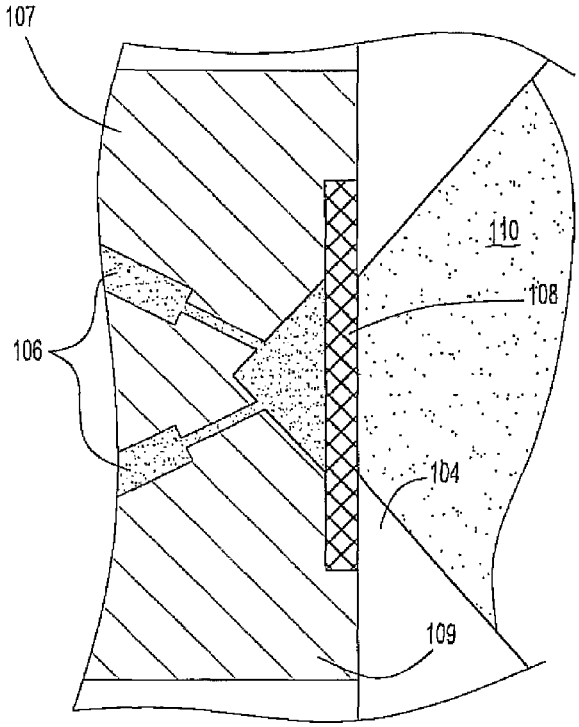
FIG. 4*b* is an enlarged view of a piston region for the fuel feed system.

Referring specifically to the flow of the aluminum powder, FIGS. 4*a*-4*b* illustrate an embodiment of the fuel feed system 100. It is appreciated that the flow of aluminum particles under pressure can be an area of concern for an aluminum power system with uneven flow rates, clogging of fuel lines and the like known to be problem areas. However, the fuel feed system 100 having aluminum particles 110 can include treatment of the particles with a silane, e.g. methylethoxysilane, such that polarizable surface groups such as hydroxyl groups can be replaced with siloxane groups or other non-polarizable, hydrophobic terminal groups and result in the: (1) elimination and/or reduction of van der Waals forces; (2) elimination and/or reduction of susceptibility to triboelectric augmentation of cohesion between the particles; and/or (3) suppression of cohesion due to capillary condensation.

The treatment can include providing a monolayer thick film of siloxane onto the surface of the aluminum particles and placing the particles in the cylinder of a piston-cylinder device. A piston 104 that has a funnel shape on one face and a flat shape on an opposite face can be forced, e.g. by gas pressure, into the fuel 110. The conical face of the piston 104 can then move into the fuel, thereby forcing the fuel to flow through a screen 108. In addition, inert gas can be forced into the fuel 110 through an inlet line 102, and as the piston 104 moves into the fuel 110 and the fuel passes through a fuel line 106, the inert gas in the interstitial spaces of the fuel can expand and provide a dense-phase fluidized particulate flow.

In some instances, a coiled flexible fuel line 106 having a ⅛-inch diameter with a 1/16-inch bore can be used to provide aluminum powder to the combustor 200. For example and for illustrative purposes only, such a fuel line 106 can provide sufficient aluminum powder fuel for a 100 hp/75 kW turbine output. In addition, a metal rod can be used to move with the piston 104 so that a position of the piston can be known as a function of time, thereby allowing for a fuel flow rate to be calculated.

Figure 5:
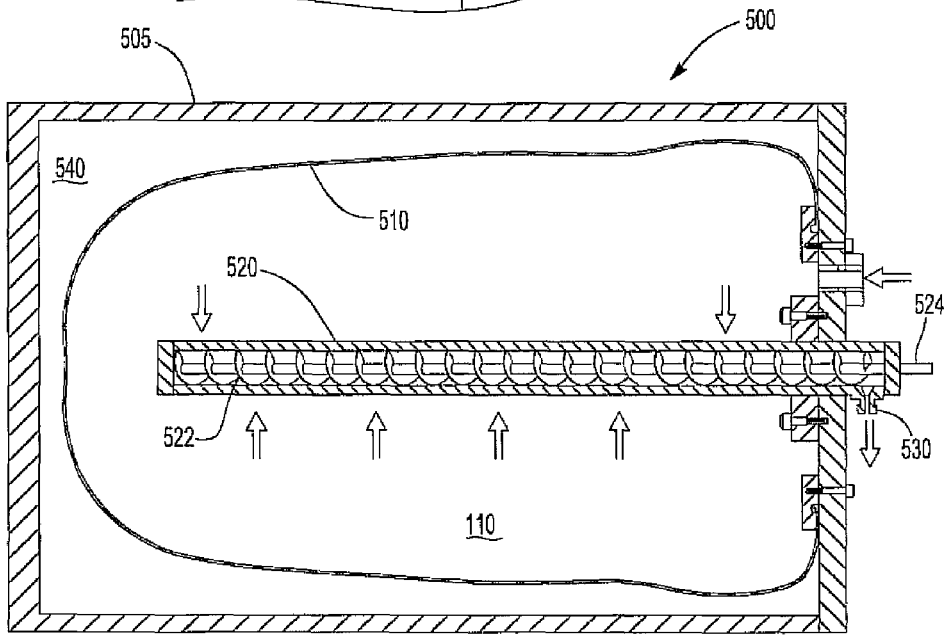
FIG. 5 is another embodiment of a fuel feed system for the aluminum combustion power system according to an embodiment of the present invention.

An alternative embodiment of a fuel feed system is shown in FIG. 5 at reference numeral 500. The fuel feed system 500 can have a container 505 with a bladder 510 that has aluminum powder fuel 110 therewithin. Pressure can be applied to a back side of bladder 510 in the region 540 and a feeder transport 520 can be used to provide the aluminum powder 110 to an exit orifice 530. In some instances, the feeder transport 520 can have a shaft 524 with an arbor plate 522, the shaft 524 and arbor plate 522 acting as a screw drive to transport the powder 110 from within the bladder 510 to the exit 530. In addition, aluminum oxide particles that exit from the combustor 200 can be separated from the steam/fly ash mixture and placed in the area 540 around the back side of the bladder 510 which was previously occupied by the aluminum powder 110. In this manner, the aluminum oxide particles can be stored on or within an underwater vehicle.

The invention is not restricted to the illustrative examples and/or embodiments described above. The examples and/or embodiments are not intended as limitations on the scope of the invention. Methods, processes, apparatus, compositions, and the like described herein are exemplary and not intended as limitations on the scope of the invention. As such, it is the following claims, including all equivalents, that define the scope of the invention.

We claim:

1. An engine that reacts aluminum with water to produce electrical and/or mechanical power, said engine comprising:

a fuel containing aluminum powder that flows like liquid under high pressure;

a steam supply system;

a combustor having an inlet, an outlet and a combustor wall;

a fuel feed system operable to pump said fuel from a fuel tank to said combustor;

a fuel injection system operable to mix steam with said fuel and spray said fuel and steam mixture into said combustor;

a water supply system operable to spray water into said combustor;

wherein said water reacts with said aluminum powder to produce molten aluminum oxide droplets, heat, steam and hydrogen, said water also solidifying said molten aluminum oxide droplets before contacting said combustor wall and prevent clogging of said combustor.

2. The engine of claim 1, wherein individual aluminum particles of said aluminum powder are coated with a silane film, the coated aluminum particles operable to be pumped through tubing having a length to diameter ratio greater than 1000.

3. The engine of claim 2, wherein said silane film is a methysiloxane film.

4. The engine of claim 1, wherein said steam supply system is a steam compressor that supplies steam from a combustor discharge to react with the aluminum fuel in the combustor.

5. The engine of claim 1, wherein said fuel feed system is operable to provide a steady flow of aluminum powder at high pressure through tubing having a length to diameter ratio greater than 1000.

6. The engine of claim 1, wherein said water supply system has a plurality of spray nozzles operable to spray water into said combustor to cool said combustor wall and prevent molten aluminum oxide from solidifying on said combustor wall.

7. The engine of claim 1, further comprising a high temperature separator operable to separate aluminum oxide particles from steam exiting said outlet of said combustor.

8. The engine of claim 7, wherein said high temperature separator provides steam with a reduced solid aluminum oxide content to said steam compressor and said turbine.

9. The engine of claim 1, further comprising a water pump operable to pump water from a surrounding environment to said combustor.

10. The engine of claim 9, further comprising a recuperator in fluid communication with said water pump and said combustor, said recuperator operable to extract heat from steam from said combustor and provide heat to water being pumped to said combustor.

11. A process for producing power from aluminum and water, the process comprising:

providing aluminum powder, steam, water and a combustor;

flowing the aluminum powder from a fuel tank to an injection nozzle;

mixing the aluminum powder with steam in the injection nozzle;

injecting the aluminum powder-steam mixture and the water into the combustor;

reacting the aluminum powder with the steam in a combustion zone within the combustor, the reaction producing molten aluminum oxide droplets and heat, the heat converting at least part of the water in the combustor into steam;

cooling the molten aluminum oxide droplets with the water injected into the combustor and producing solidified aluminum oxide particles;

flowing a steam plus aluminum oxide particles mixture out of the combustor;

separating at least part of the aluminum oxide particles from the steam plus aluminum oxide particles mixture to produce a turbine quality steam; and passing the turbine quality steam into a steam turbine, the steam turbine producing power.

12. The process of claim 11, wherein individual aluminum particles of the aluminum powder are coated with a silane film and the coated aluminum particles flow from the fuel tank to the injection nozzle through a fuel line having a length to diameter ratio greater than 1000.

13. The process of claim 12, wherein the silane film is a methysiloxane film.

14. The process of claim 11, further including mixing the aluminum powder with high pressure steam in the injection nozzle, the high pressure steam provided by a steam compressor.

15. The process of claim 14, further including providing a high temperature separator, the high temperature separator separating at least 99% of the aluminum oxide particles from the steam out of the steam plus aluminum oxide particles mixture.

16. The process of claim 15, further including providing steam from the high temperature separator to the steam compressor.

17. The process of claim 11, further including providing a plurality of spray nozzles and injecting the water into the combustor through the plurality of spray nozzles.

18. The process of claim 11, wherein the aluminum powder, steam, water, combustor, high temperature separator, steam compressor and the steam turbine provide at least 75 kilowatts of power for a time period of at least 10 minutes.

* * * * *